US010619361B2

(12) United States Patent
Holtschmidt

(10) Patent No.: US 10,619,361 B2
(45) Date of Patent: Apr. 14, 2020

(54) TRANSITION PROFILE BETWEEN FLOORING ELEMENTS

(71) Applicant: KUEBERIT PROFILE SYSTEMS GMBH & CO. KG, Luedenscheid (DE)

(72) Inventor: Olaf Holtschmidt, Neuenrade (DE)

(73) Assignee: KUEBERIT PROFILE SYSTEMS GMBH & CO. KG, Luedenscheid (DE)

( * ) Notice: Subject to any disclaimer, the term of this patent is extended or adjusted under 35 U.S.C. 154(b) by 0 days.

(21) Appl. No.: 16/141,184

(22) Filed: Sep. 25, 2018

(65) Prior Publication Data

US 2019/0249445 A1 Aug. 15, 2019

(30) Foreign Application Priority Data

Feb. 14, 2018 (DE) ..... 10 2018 103 311

(51) Int. Cl.
*E04F 19/06* (2006.01)

(52) U.S. Cl.
CPC ..... *E04F 19/068* (2013.01); *E04F 19/062* (2013.01); *E04F 19/065* (2013.01); *E04F 19/066* (2013.01)

(58) Field of Classification Search
CPC ..... E04F 19/066; E04F 19/062; E04F 19/063; E04F 19/061; E04F 15/02005; E04F 21/0092; E04F 19/02; E04F 19/065
See application file for complete search history.

(56) References Cited

U.S. PATENT DOCUMENTS 6,345,480 B1 * 2/2002 Kemper ..... E04F 19/061 403/118
6,523,314 B1 * 2/2003 LaLonde ..... E04B 9/005 52/506.07
6,588,165 B1 * 7/2003 Wright ..... E04F 19/06 52/459
7,784,238 B2 * 8/2010 Bannister ..... E04F 19/02 52/278
7,861,487 B2 * 1/2011 Kufner ..... E04F 21/0092 33/526
8,024,906 B1 * 9/2011 Nelson ..... E04D 13/165 52/410
8,099,921 B2 * 1/2012 Muehlebach ..... E04F 19/06 52/396.04
8,245,474 B2 * 8/2012 Schacht ..... E04F 19/061 52/100
2007/0251186 A1 * 11/2007 Rice ..... E04B 2/7457 52/483.1
2017/0234004 A1 * 8/2017 Pilz ..... E04B 1/948 52/232

FOREIGN PATENT DOCUMENTS

DE 20320273 U1 9/2004
DE 202015104353 U1 10/2015
EP 3130724 A1 * 2/2017 ..... E04F 15/02

* cited by examiner

*Primary Examiner* — Brian E Glessner
*Assistant Examiner* — Daniel J Kenny
(74) *Attorney, Agent, or Firm* — Scully Scott Murphy and Presser

(57) ABSTRACT

The present invention relates to a device for adjusting the support height of a retaining mechanism of a base profile of a floor profile arrangement for receiving, so as to attach, a covering profile for joints.

15 Claims, 3 Drawing Sheets

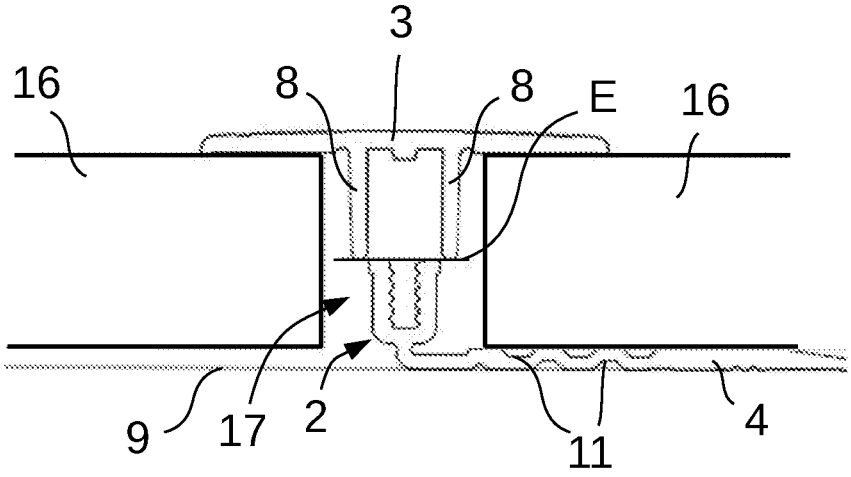
Fig. 3a
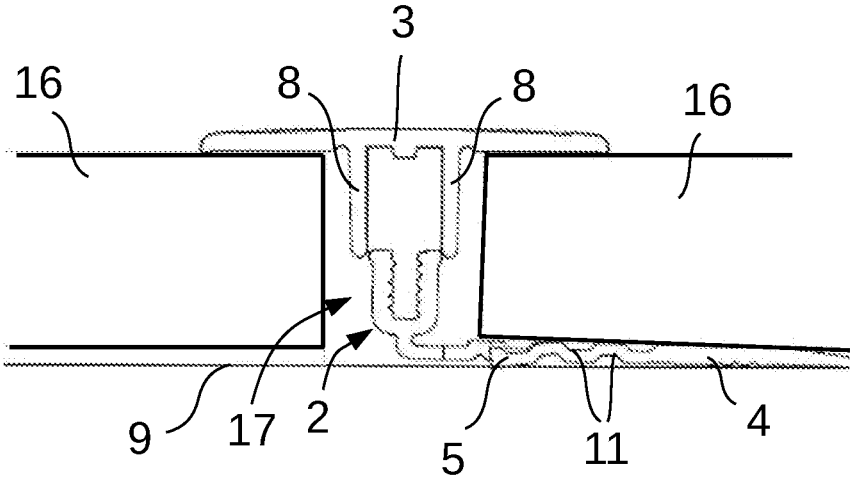
Fig. 3b
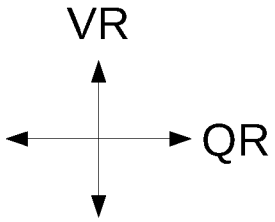

TRANSITION PROFILE BETWEEN FLOORING ELEMENTS

The present invention relates to a base profile of a floor profile arrangement for receiving, so as to attach, a covering profile for joints.

Type-defining floor profile arrangements are known from the prior art. DE 203 20 273 U1 describes a floor profile arrangement, which is equipped with a joint arrangement such that the covering profile can tilt in the direction of the thinner floor covering when there is bridging of a joint between floor coverings of different thicknesses, without bending the cover flaps of the covering profile.

Publication DE 20 2015 104 353 U1 discloses a floor profile arrangement with a base profile and a covering profile for use in joints between adjacent floor coverings. The base profile of the floor arrangement has a retaining mechanism which is formed to receive, so as to attach, a covering profile and comprises a horizontal base support arm to be attached to the floor. The base support arm and the retaining mechanism are connected by means of a transition section. Furthermore, the retaining mechanism is tiltable opposite the base support arm, in the transverse direction with respect to one floor covering edge or another, by means of bending the transition section.

It is beneficial for a floor profile arrangement to be suitable for both thin and thick floor coverings. In practice however, it has been problematic for a floor profile arrangement suitable for thin and thick floor coverings that, with thick floor coverings, the vertical distance between the base profile and/or the retaining mechanism arranged on the base profile and the covering profile is too big, to the extent that the base profile and the covering profile can be placed into a clear fastening position for attachment to one another. With tall floor coverings, the attachment arms typically formed on the covering profile and surrounding the retaining mechanism are too short to ensure the placement of the covering profile on the base profile, arranged in a fixed position next to each other, before they are fastened. However, the attachment arms cannot be extended as desired, because, with thin floor coverings, they will otherwise rest directly on the base profile, while the covering profile is still protruding beyond the floor covering.

Thus, the object of the present invention is to provide a base profile of a floor profile arrangement, which can be used equally well for thin and thick floor coverings adjoining the joint, using the same covering profile.

According to the invention, a base profile of a floor profile arrangement having a support arm and a retaining mechanism is proposed, which is formed to receive, so as to attach, a covering profile intended for covering a joint. A strip section, which can be pushed under a floor covering, is characterized herein as the support arm. The covering profile is attached to the retaining mechanism. At least one bending part is formed on the support arm, with it being possible to bend the bending part in a first vertical direction, which points to a contact surface upon proper use, opposite the support arm. The base or the wall on which the base profile is placed so as to make contact is defined as the contact surface. Orthogonally to this vertical direction, there is a longitudinal direction of the base profile, extending along the joint.

In the bent state, the bending part forms a support for the base profile on the contact surface and shifts, under proper use, the retaining mechanism opposite the support arm placed on the contact surface into a second vertical direction opposite the first vertical direction, whereby the retaining mechanism of the base profile is raised, into the vertical retaining direction, up to the covering profile. Due to this shift in position of the retaining mechanism into the second vertical direction within the joint, an arrangement, in a fixed position, of the covering profile is ensured on the retaining mechanism, even with thick floor coverings, because parts of the covering profile can engage with the retaining mechanism in order to establish the position of the covering profile on the retaining mechanism such that subsequently the covering profile can be attached, particularly bolted, to the retaining mechanism.

An advantageous embodiment variant provides that the at least one bending part be formed as a single part on the support arm. In doing so, it is favorable when the number of parts and consequently the installation effort for users is reduced as compared to a multi-part solution. The entire base profile may be composed of several parts; it is preferable, however, for it to be formed as a single part. A multi-part solution, for example, provides for a joint arrangement on the base profile, in which the retaining mechanism is used as a separate, flexibly moveable part.

In one advantageous embodiment, the bending part is formed on the support arm by means of at least one cut, which is preferably produced by a punch-out. This enables the formation of a bending part on the already existing support arm in just one work step and without any additional material expenses.

In one further development, the base profile has multiple cuts spaced apart on the support arm in the longitudinal direction extending along the joint, wherein the at least one bending part is formed by at least one section between the respective cuts. The plurality of cuts can be variably designed with respect to its position and be executed economically using the punch.

In an especially advantageous embodiment of the invention, the bending part is formed as a tab, which is bendable in the first vertical direction, with at least one facing edge that is freely movable opposite the support arm. This ensures that the tab is steplessly bendable and thus also that the support height of the retaining mechanism can be adjusted steplessly within its limits.

Furthermore, the facing edge of the tab forms the support for the base profile on the contact surface. The tab can be formed by a cut and/or a punch-out, for example as a semicircle or in a U-shape, in the support arm or the transition section, and the free facing edge thereof can point in any direction in the plane of the longitudinal and transverse directions. The free facing edge of the tab can be bent downward, opposite the support arm to be attached to the contact surface, using a tool, in order to form the support.

In one embodiment of the invention, the tab has a width of 3-50 mm, particularly 5-30 mm, further preferably 5-20 mm, in the longitudinal direction along the joint. In practice, such type of tab can be easily bent with a screwdriver or pliers.

One further development provides is that the support arm has at least one recess extending parallel to the retaining mechanism, in the transverse direction adjoining the retaining mechanism, with the recess being formed to receive an attachment arm, of the covering profile, extending vertically with respect to the retaining mechanism, in the installed state, in order to enlarge the adjustment area between the covering profile and the base profile. The transverse direction extends orthogonally, with respect to the vertical direction and the longitudinal direction, between the two adjacent floor coverings, i.e. along the width of the joint. The recess enables longer attachment arms of the covering profile for thick floor coverings, which would otherwise rest directly on the base profile with narrow floor coverings, while the covering profile is still protruding beyond the floor covering. This enables the covering of a larger range of thicknesses of floor coverings with the same covering profile. As a side benefit, the recesses can also be used to additionally secure the covering profile against position changes in the longitudinal and transverse directions when the edges of the recess are blocking a movement of the attachment arms of the covering profile in both directions.

In another advantageous embodiment, the at least one bending part is formed on the recess of the support arm. This positioning enables the cuts and consequently also the formation of the bending part to be implemented simply. In addition, the bending part can be easily reached at the recess in order to bend it as needed with a conventional tool such as a screwdriver or pliers.

Preferably, the base profile is formed such that the support arm has multiple recesses spaced apart from one another in the longitudinal direction, wherein a bending part is formed at each of the recesses, on the support arm. In doing so, it is beneficial that multiple bending parts consequently indicate multiple supports as well, whereby the stability of a raised support arm is significantly improved. In addition, multiple extended attachment arms can be formed on one covering profile due to the increased number of recesses, whereby the stability is further improved.

In another exemplary embodiment, the at least one cut extends from the recess in a transverse direction in the support arm; in doing so, it does not matter whether this is in one transverse direction or the other.

In one advantageous embodiment of the invention, the support arm has a transition section directly adjacent the retaining mechanism in the transverse direction, wherein the transition section of the support arm has at least one first groove extending in the longitudinal direction. Preferably, multiple grooves extending in the longitudinal direction are formed at the transition section of the support arm, with the grooves being sunk so as to alternate on two opposite surfaces (upper side and lower side) of the transition section. In doing so, it is beneficial that the transition section is thinner, with respect to the material thickness, in comparison with the support arm due to the grooves in the transition section, has locally less stiffness, and can be bent over the entire length of the base profile in the vertical direction, along the transition section.

According to the invention, the at least one cut or the plurality of cuts extends from the recess in the transverse direction to the transition section of the support arm by means of the at least one groove. This results in a positioning of the bending part at the groove, or, in other words, the groove extends through the bending part. The lower stiffness at the groove is an optimum place for bending the bending part.

When viewed at the cross-section, the retaining mechanism is preferably U-shaped and formed with two retaining bars extending in the vertical direction, which form a toothed edge between them. The covering profile can be fixed in position through bolting at the retaining bars or their toothed edge. Alternative embodiments for attaching the covering profile to the retaining mechanism are likewise comprised in the exemplary embodiments, wherein the attachment takes place using clips, springs, or latches.

In one exemplary embodiment, the retaining mechanism is formed at the support arm, at a securing bar extending in the vertical direction. The securing bar is dimensioned to be sufficiently narrow in the transverse direction such that the retaining mechanism has a certain degree of flexibility and also capacity to bend in the transverse direction. This facilitates the possibility of aligning the retaining mechanism with respect to the covering profile when there are position changes of the retaining mechanism in the vertical direction.

The base profile is preferably made from aluminum.

Other advantageous further developments of the invention are characterized in the dependent claims and/or are shown in more detail in the following, by means of the figures, along with the description of the preferred embodiment of the invention. In the drawings:

Figure 2:
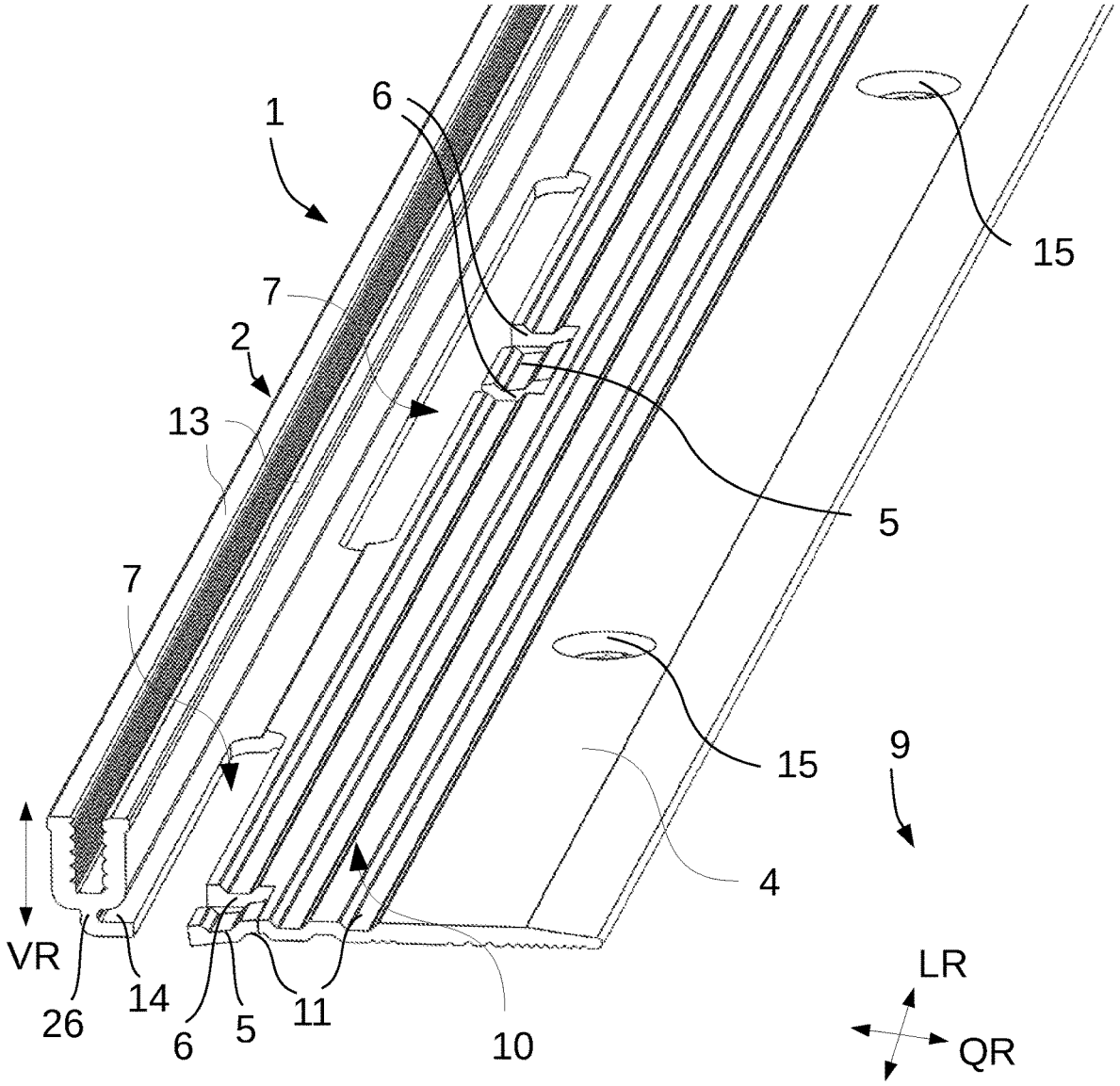
FIG. 2 shows a perspective view of a base profile in a further embodiment variant.

FIG. 3*a* shows a side view of the base profile from FIG. 2, in an original state, with the covering profile indicated;

FIG. 3*b* shows a side view of the base profile from FIG. 3*a*, with the vertically offset retaining mechanism and covering profile indicated.

The invention is described in the following using an exemplary embodiment with reference to FIGS. 1 to 3*a*, 3*b* wherein use of the same reference numerals indicate the same structure and/or functional features.

Figure 1:
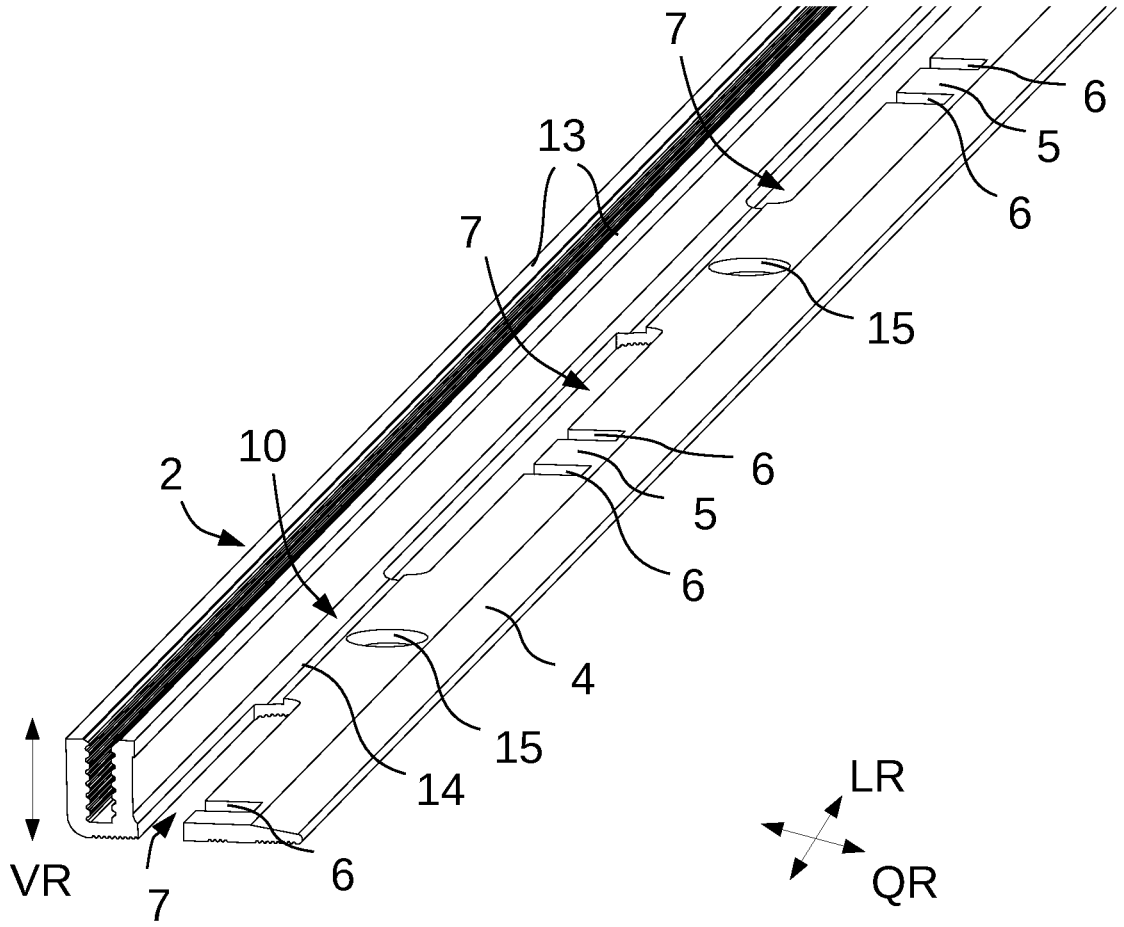
FIG. 1 shows a perspective view of a base profile in a first embodiment variant.

FIG. 1 shows an overall perspective view of an inventive base profile 1 of a floor profile arrangement. The longitudinal, vertical, and transverse directions are defined as they are indicated in the overall disclosure.

The base profile 1 has a support arm 4, a transition section 10, and a retaining mechanism 2, which is formed in the shape of a U when viewed in the cross-section, by means of two retaining bars 13, and has a toothed edge at the inner surfaces of the retaining bars 13 thereof. Bolts can be attached and a covering profile 3, indicated in FIGS. 3*a* and 3*b*, can be affixed to the toothed edge of the retaining bars 13.

In the embodiment according to FIG. 1, the transition section 10 connecting the support arm 4 and the retaining mechanism 2 is formed by a securing bar 14, which has less material thickness than the support arm 4. This ensures a certain amount of flexibility and capacity to bend in the transverse direction as compared to the support arm 4. The securing bar 14 extends up to the retaining mechanism 2, in the extension of the support arm 4.

Furthermore, FIG. 1 shows that there are multiple spaced-apart recesses 7 in the transition section 10, formed as a slotted hole punch-out, extending in the longitudinal direction along the securing bar 14, which are formed to receive the attachment arms 8 of the covering profile 3 (see FIGS. 3*a*, 3*b*). Two identically formed cuts 6 extend over approximately half the total width of the support arm 4, at each of the recesses 7. As viewed in the longitudinal direction, the cuts 6 are positioned in the middle with respect to the recesses 7 and form the bending part 5 between them in the form of a tab, which can be pushed downward in the vertical direction, opposite the support arm 4, by means of a tool. FIG. 1 shows a state in which the bending parts 5 are not bent.

In the support arm 4, a borehole 15, by means of which the support arm 4 is affixed to a contact surface, i.e. a flooring or a wall, with an attachment means, e.g. a bolt, is provided between every two bending parts 5. Along the edge, the support arm 4 extends in a ramp-like manner, wherein its material thickness continually reduces.

FIG. 2 shows an alternative embodiment variant of the base profile 1, wherein features identical to the embodiment according to FIG. 1 are not described again but nevertheless are considered as disclosed.

With the embodiment according to FIG. 2, the base profile 1 is formed with an alternative embodiment of the securing bar 14 and of the transition area 10. In the embodiment according to FIG. 2, the securing bar 14 is formed in the vertical direction, in the middle underneath the U-shaped retaining mechanism 2, and essentially describes an L-shape, when viewed in the cross-section, with a securing bar 26 extending in the vertical direction. In this position of the retaining mechanism 2, securing bar 14 and/or 26 enables a much greater flexibility in the retaining mechanism 2 in the transverse direction and simplifies, in this manner, the alignment of the retaining mechanism 2 opposite the covering profile 3.

The transition section 10 between the support arm 4 and the retaining mechanism 2 with this embodiment has multiple grooves 11 extending in the longitudinal direction, which are sunk so as to alternate, when viewed in the transverse direction, on two opposite surfaces in the transition section 10. Furthermore, FIG. 2 shows that the cuts 6 extend starting from the recesses 7 in the transverse direction in the transition section 10 over a groove 11 on the upper side of the base profile 1. In the embodiment according to FIG. 2, the bending parts 5 are bent downward in the vertical direction and provide the support for the base profile 1, in which the retaining mechanism 2 is shifted upwards vertically in height compared to the support arm 4 to be attached on the contact surface 9, which corresponds to a bending height of the bending part 5 in the vertical direction.

FIGS. 3*a* and 3*b* show side views of the base profile 1 from FIG. 2, onto which a covering profile 3 is placed in order to cover two edges of thick floor coverings 16. FIG. 3*a* shows the base profile 1 in a position in which the bending parts 5 are not bent and consequently the attachment arms 8 of the covering profile 3 end on the edge plane E of the retaining mechanism 2 and do not reach the retaining bars 13 of the retaining mechanism 2, so as to ensure prior fixing in position between the covering profile 3 and the base profile 1.

FIG. 3*b* shows the base profile from FIG. 3*a*, wherein the bending parts 5 are bent in the vertical direction opposite the support arm 4 and consequently the retaining mechanism 2 is shifted or raised upward vertically into the joint 17 and no longer rests on the contact surface 9 completely or over the entire surface. Thus, the attachment arms 8 of the covering profile 3 can reach the securing bars 13 of the retaining mechanism 2 and can be placed for prior fixing or in a fixed position next to each other for lateral contact. The covering profile 3 can thus be positioned precisely opposite the base profile 1 such that the covering profile 3 is to be attached to the base profile 1 in a fixed position.

The invention is not limited in its embodiment to the aforementioned preferred exemplary embodiments. Rather a number of variants is conceivable, which would make use of the solution shown even with essentially different embodiments. For example, the bending parts 5 may also be provided in an area that is not at the height of the recesses 7. The bending parts 5 may also be punched as tabs in the support arms 4 or the transition section 10. Furthermore, the cuts 6 may also extend at an angle opposite the transverse direction and thus be parallel to one another or flipped.

The invention claimed is:

1. A base profile of a floor profile arrangement, comprising a support arm, a retaining mechanism, configured to receive and attach a joint covering profile, wherein, on the support arm, at least one bending part is positioned, the bending part configured to point, in use, in a first vertical direction, relative to a base profile to contact a surface, the bending part being bent, in use, outside a plane formed by the support arm, the bending part when bent in use forming a support for the base profile on the contact surface and, as a result, shifting the retaining mechanism, into a second vertical direction, opposite the first vertical direction wherein the bending part is formed on the support arm by means of at least one cut, and wherein multiple cuts are formed spaced apart on the support arm in a longitudinal direction extending along the joint covered by the joint covering mechanism, wherein the at least one bending part is formed by at least one section between the respective cuts.

2. The base profile according to claim 1, wherein the at least one bending part is formed as a single part on the support arm.

3. The base profile according to claim 1, wherein the bending part is formed as a tab, which is bendable in the first vertical direction, with at least one facing edge that is freely movable out of the plane of the support arm.

4. The base profile according to claim 3, wherein the tab has a width of 3-50 mm in the longitudinal direction along the joint.

5. The base profile according to claim 1, wherein the support arm has at least one recess extending parallel to a length of the retaining mechanism the recess being transversely disposed relative to the support arm, with the recess being formed to receive an attachment arm of the covering profile, in use.

6. The base profile according to claim 5, wherein the at least one bending part is formed at the recess of the support arm.

7. The base profile according to claim 5, wherein the support arm has multiple recesses spaced apart from one another in the longitudinal direction, wherein the at least one bending part is formed at each of the recesses, on the support arm.

8. The base profile according to claim 5, wherein the at least one cut extends, starting from the recess, in a transverse direction, with respect to a length of the retaining mechanism and orthogonally with respect to the vertical direction and the longitudinal direction, or the cuts extend in the support arm at an angle with respect to the transverse direction.

9. The base profile according to claim 5, wherein the at least one cut extends, starting from the recess, in a transverse direction to the transition section of the support arm over at least one groove.

10. The base profile according to claim 1, wherein the support arm has a transition section directly adjacent the retaining mechanism in the transverse direction, wherein the transition section of the support arm has at least one first groove extending in the longitudinal direction.

11. The base profile according to claim 10, wherein the transition section of the support arm has multiple grooves extending in the longitudinal direction, which alternate, when viewed in the transverse direction, on two opposite surfaces of the transition section.

12. The base profile according to claim 1, wherein the retaining mechanism is U shaped, when viewed in the cross-section, with two retaining bars extending in the vertical direction, which form a toothed edge between them.

13. The base profile according to claim 1, wherein the retaining mechanism is formed on the support arm by means of a securing bar extending in the vertical direction.

14. The base profile according to claim 1, wherein the base profile is formed from aluminum.

15. A floor profile arrangement with a base profile according to claim 1, the floor profile arrangement including a covering profile configured to be attached to the base profile.

* * * * *